US009557676B2

(12) United States Patent
Tsurumi et al.

(10) Patent No.: US 9,557,676 B2
(45) Date of Patent: Jan. 31, 2017

(54) ELECTROSTATIC CHARGE IMAGE DEVELOPING CARRIER, ELECTROSTATIC CHARGE IMAGE DEVELOPER, AND DEVELOPER CARTRIDGE

(71) Applicant: FUJI XEROX CO., LTD., Tokyo (JP)

(72) Inventors: Yosuke Tsurumi, Kanagawa (JP); Shintaro Anno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/586,420

(22) Filed: Dec. 30, 2014

(65) Prior Publication Data

US 2015/0268578 A1 Sep. 24, 2015

(30) Foreign Application Priority Data

Mar. 24, 2014 (JP) ..... 2014-060857

(51) Int. Cl.
*G03G 9/107* (2006.01)
*G03G 9/113* (2006.01)

(52) U.S. Cl.
CPC ..... *G03G 9/107* (2013.01); *G03G 9/113* (2013.01); *G03G 9/1133* (2013.01); *G03G 9/1139* (2013.01)

(58) Field of Classification Search
CPC ..... G03G 9/107; G03G 9/1075; G03G 9/113; G03G 9/1139
USPC ..... 430/111.3, 111.31, 111.32, 111.33, 430/111.34, 111.35
See application file for complete search history.

(56) References Cited

U.S. PATENT DOCUMENTS 5,512,402 A 4/1996 Okado et al.
5,670,288 A 9/1997 Okado et al.
6,001,527 A * 12/1999 Ishihara ..... G03G 9/0819 399/252
7,291,436 B2 * 11/2007 Nakamura ..... G03G 9/0821 430/110.2
8,422,923 B2 * 4/2013 Wu ..... C08G 73/10 252/500
2006/0045571 A1 * 3/2006 Matsuura ..... G03G 21/0064 399/149
2007/0243479 A1 * 10/2007 Yoshihara ..... G03G 9/10 430/110.3
2012/0092290 A1 * 4/2012 Itoh ..... G06F 3/044 345/174

FOREIGN PATENT DOCUMENTS

JP H0798521 A 4/1995
JP 2009086340 A 4/2009
JP 2014-153476 A * 8/2014

OTHER PUBLICATIONS

ESPACENET English-language machine-assisted translation of JP 2014-153476 A (pub. Aug. 2014).*

* cited by examiner

*Primary Examiner* — Janis L Dote
(74) *Attorney, Agent, or Firm* — Oliff PLC

(57) ABSTRACT

An electrostatic charge image developing carrier includes magnetic particles, wherein the magnetic particles have an unevenness average Sm of a surface, an arithmetic surface roughness Ra of a surface, a BET specific surface area A, and a volume average particle diameter D50v satisfying the following expressions (1) to (4):

$$0.5\ \mu m \leq Sm \leq 2.5\ \mu m \quad (1)$$

$$0.3\ \mu m \leq Ra \leq 1.2\ \mu m \quad (2)$$

$$0.14\ m^2/g \leq A \leq 0.20\ m^2/g \quad (3)$$

$$18\ \mu m \leq D50v \leq 32\ \mu m. \quad (4)$$

16 Claims, 2 Drawing Sheets

ELECTROSTATIC CHARGE IMAGE DEVELOPING CARRIER, ELECTROSTATIC CHARGE IMAGE DEVELOPER, AND DEVELOPER CARTRIDGE

CROSS-REFERENCE TO RELATED APPLICATIONS

This application is based on and claims priority under 35 USC 115 from Japanese Patent Application No. 2014-060857 filed Mar. 24, 2014.

BACKGROUND

1. Technical Field

The present invention relates to an electrostatic charge image developing carrier, an electrostatic charge image developer, and a developer cartridge.

2. Related Art

An electrophotographic method is a method of obtaining an image by developing an electrostatic latent image formed on a surface of an electrostatic latent image holding member (photoreceptor) using a toner containing a colorant, transferring an obtained toner image to a surface of a recording medium, and fixing the image with a heat roll or the like. Further, in order for the latent image holding member to form an electrostatic latent image again, a cleaning process is omitted in some cases when a transferred residual toner is depleted in a case where the transferred residual toner is cleaned or the like so that a spherical toner particle is used. A dry developer used for the electrophotographic method is largely classified into a single-component developer using a toner alone obtained by mixing a binder resin with a colorant or the like and a two-component developer obtained by mixing the toner with a carrier.

SUMMARY

According to an aspect of the invention, there is provided an electrostatic charge image developing carrier including magnetic particles, wherein the magnetic particles have an unevenness average interval Sm of a surface, an arithmetic surface roughness Ra of a surface, a BET specific surface area A, and a volume average particle diameter D50v satisfying the following expressions (1) to (4):

$$0.5\ \mu m \le Sm \le 2.5\ \mu m \quad (1)$$

$$0.3\ \mu m \le Ra \le 1.2\ \mu m \quad (2)$$

$$0.14\ m^2/g \le A \le 0.20\ m^2/g \quad (3)$$

$$18\ \mu m \le D50v \le 32\ \mu m. \quad (4)$$

BRIEF DESCRIPTION OF THE DRAWINGS

Exemplary embodiments of the present invention will be described in detail based on the following figures, wherein.

DETAILED DESCRIPTION

Figure 1:
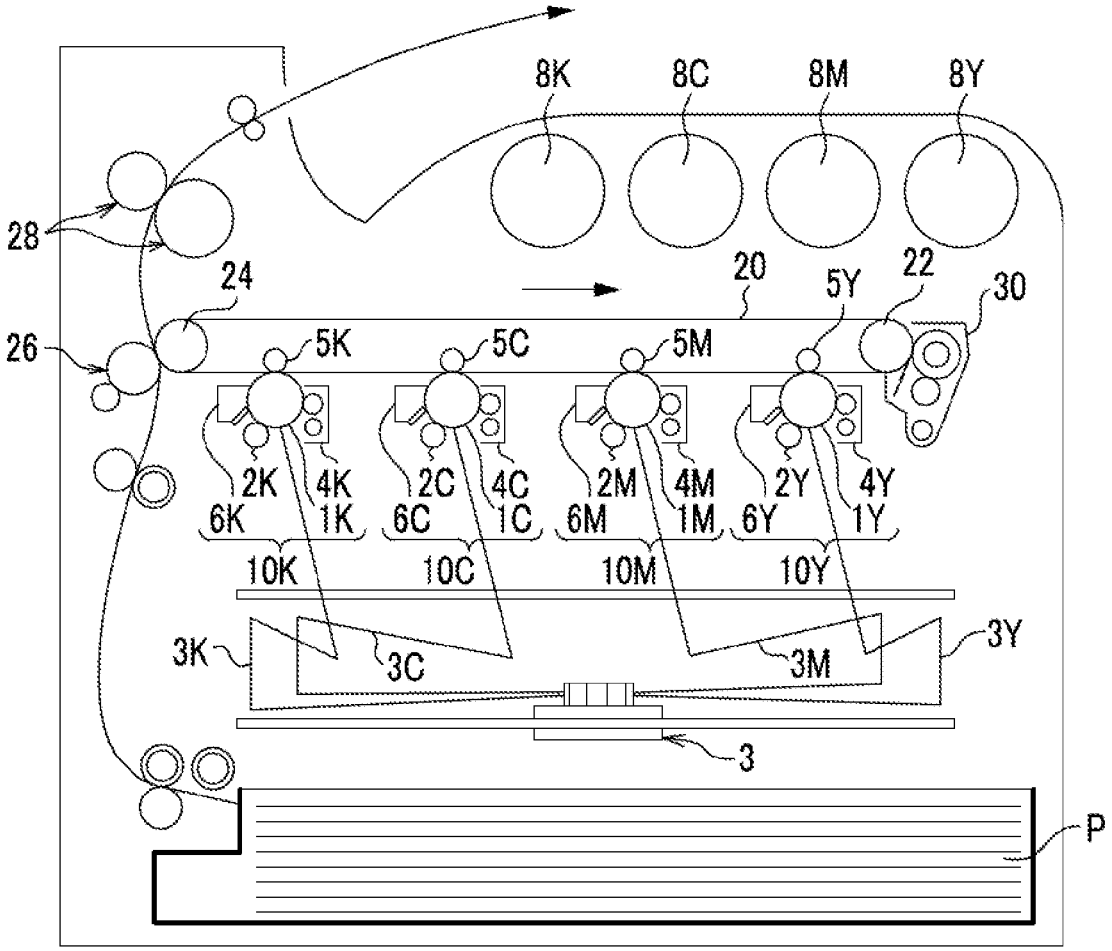
FIG. 1 is a view schematically illustrating an example of a configuration of an image forming apparatus according to the present exemplary embodiment.

Hereinafter, exemplary embodiments which are examples of the present invention will be described in detail.

Electrostatic Charge Image Developing Carrier

An electrostatic charge image developing carrier according to the present exemplary embodiment contains magnetic particles in which an unevenness average interval Sm of the surface, an arithmetic surface roughness Ra of the surface, a BET specific surface area A, and a volume average particle diameter D50v satisfy all of the following expressions (1) to (4).

$$0.5\ \mu m \le Sm \le 2.5\ \mu m \quad (1)$$

$$0.3\ \mu m \le Ra \le 1.2\ \mu m \quad (2)$$

$$0.14\ m^2/g \le A \le 0.20\ m^2/g \quad (3)$$

$$18\ \mu m \le D50v \le 32\ \mu m \quad (4)$$

When an electrostatic charge image developer (hereinafter, referred to as a "developer" in some cases) including the electrostatic charge image developing carrier (hereinafter, referred to as a "carrier" in some cases) according to the present exemplary embodiment is used, density unevenness of an image is prevented in a case where high density images are continuously formed in a high temperature and high humidity environment (30° C., RH88%). The reason thereof is unclear, but may be estimated as follows.

In image formation using an electrophotographic system, generally, a developer a developing device is stirred and then charged. The charged developer is transported to a developer holding member of the developing device, an electrostatic latent image formed on the surface of an electrophotographic photoreceptor facing the developer holding member is developed by a toner, and a toner image is formed. At this time, when there are defects in the charging of a toner, a phenomenon in which an image is developed by the toner more than necessary or is not developed by the toner occurs, and thus, density unevenness or image defect on the printing surface occurs.

In two-component development, a toner is charged by mainly stirring the toner and the carrier in a developing device. Accordingly, when stirring of the toner and the carrier in a developing device is not sufficiently performed, defects in the charging of the toner are formed. When the supply amount of a toner becomes increased when high density images, which needs a large amount of toner to be supplied, are continuously printed, defects in the charging of the toner tend to be easily formed because the mixing and stirring of the toner and the carrier in the developing device do not keep up with the supply amount thereof.

Further, since it is difficult to charge a toner in a high temperature and high humidity environment, defects in images such as density unevenness tend to significantly appear when high density images are continuously printed in a high temperature and high humidity environment.

In the electrostatic charge image developing carrier according to the present exemplary embodiment, it is considered that the stress on the toner at the time of stirring the developer becomes preferable and stable charging may be applied to the toner even when the toner supply amount becomes large when the surface roughness and the particle diameter of the magnetic particles constituting the carrier satisfy the above-described ranges (1), (2), and (4).

Further, it is considered that defects in the charging in a high temperature and high humidity environment may be prevented since the contact between moisture and the toner adhered to the magnetic particles in a high temperature and high humidity environment becomes less when the BET specific surface area of the magnetic particles satisfies the above-described range (3).

As a result, it is considered that fluctuation in the density of an image (density unevenness) at the time of continuous high density-printing in a high temperature and high humidity environment may be prevented when the physical properties of the magnetic particles satisfy the conditions of (1) to (4).

Hereinafter, respective physical properties the magnetic particles constituting the carrier according to the present exemplary embodiment will be described in detail. Further, the unevenness average interval Sm of the surface of magnetic particles, the arithmetic surface roughness Ra of the surface thereof, the BET specific surface area A, and the volume average particle diameter D50v are values respectively measured by the methods described below in Examples.

Surface Roughness (Unevenness Average Interval Sm of Surface and Arithmetic Surface Roughness Ra of Surface)

The stirring in the developing device is adjusted by the shape or a transporting unit of the developing device, but it is necessary for the toner and the carrier to be in contact and be rubbed with each other sufficiently for performing charging using the contact between the toner and the carrier. When the surface unevenness of the magnetic particles satisfies the expressions of "0.5 μm≤Sm≤2.5 μm" and "0.3 μm≤Ra≤1.2 μm, the friction between the toner and the carrier at the time of fluidization of the developer becomes preferable so that excellent charging may be obtained.

When the unevenness average interval Sm of the surface of magnetic particles is less than 0.5 μm, since the contact area between the carrier and the toner becomes smaller, an appropriate level of contact charging may not be obtained. When the unevenness average interval Sm is greater than 2.5 μm, fluidity of the toner becomes worse because of extremely large surface unevenness and thus the charging of the toner is difficult in some cases.

The unevenness average interval Sm of the surface of magnetic particles is preferably in the range of 0.8 μm to 1.5 μm and more preferably in the range of 0.8 μm to 1.0 μm.

Further, when the arithmetic surface roughness Ra of the surface of magnetic particles is smaller than 0.3 μm, the surface of the carrier becomes slippery, and thus, an appropriate level of contact charging may not be obtained. When the arithmetic surface roughness Ra of the surface of magnetic particles is greater than 1.2 μm, since the developer is fixed and becomes difficult to be moved the contact chance between the toner and the carrier becomes reduced so that defects in the charging are formed in some cases.

The arithmetic surface roughness Ra of magnetic particles is preferably in the range of 0.5 μm to 1.0 μm and more preferably in the range of 0.5 μm to 0.6 μm.

Volume Average Particle Size D50v

When the volume average particle diameter D50v of magnetic particles is in an appropriate range, a balance between stirring of the developer and deterioration due to stirring stress applied to the developer may be achieved. When the volume average particle diameter D50v of magnetic particles is in the range of 18 μm to 32 μm, it is possible to obtain excellent charging using stirring while stress because of application of the surface unevenness is reduced. When the volume average particle diameter D50v of magnetic particles is less than 18 μm, defects in stirring of the developer are formed in some cases. When the volume average particle diameter D50v of magnetic particles is greater than 32 μm, deterioration of the toner due to the stirring stress on the developer advances, and defects in the charging are formed in some cases.

The volume average particle diameter D50v of magnetic particles is preferably in the range of 20 μm to 30 μm and more preferably in the range of 24 μm to 30 μm.

BET Specific Surface Area A

The charge of the developer tends to be easily unstable in a high temperature and high humidity environment, but the influence of the contact between the toner and the carrier is suppressed in some cases because it is easy to concentrate on a recess of the carrier due to the influence of moisture caused by the humidity when the BET specific surface area is in the range of 0.14 $m^2/g$ to 0.20 $m^2/g$. Accordingly, an excellent image may be obtained in a high temperature and high humidity environment. When the BET specific surface area is smaller than 0.14 $m^2/g$, the above-described effects may not be obtained in some cases. When the BET specific surface area is greater than 0.20 $m^2/g$, the moisture content is increased as a whole and leakage of the charge occurs so that defects in the charging are formed in some cases.

The BET specific surface area A of magnetic particles is preferably in the range of 0.15 $m^2/g$ to 0.18 $m^2/g$ and more preferably in the range of 0.16 μm to 0.18 μm.

A method of producing magnetic particles in the present exemplary embodiment is not particularly limited, and magnetic particles may be produced as follows.

The surface roughness (the unevenness average interval Sm of the surface and the arithmetic surface roughness Ra of the surface) of magnetic particles of the carrier may be adjusted to a certain extent using the temperature and the oxygen concentration during firing, but the main purpose of firing is to change the structure of magnetic particles into a structure having magnetization. Further, since the surface roughness, the particle diameter, and the BET specific surface area are correlated, it is difficult to achieve the unevenness average interval Sm of the surface, the arithmetic surface roughness Ra of the surface, and the BET specific surface area A satisfying the above-described ranges according to the present exemplary embodiment by the temperature and the oxygen concentration during firing.

For this reason, the magnetic particles constituting the carrier according to the present exemplary embodiment may be preferably produced by the combination of (A) to (E) below.

(A) Pre-firing is performed before firing.

(B) The magnetic particles are further pulverized and granulated from slurries whose pulverized particle diameter is adjusted.

(C) $SiO_2$ or $SrCO_3$ is used as a surface modifier.

(D) The temperature and the oxygen concentration during firing are adjusted.

(E) The temperature of the magnetic particles obtained by firing is changed while the magnetic particles are fluidized.

After pre-firing is performed prior to firing, the magnetic particles are pulverized so as to control the particle diameter thereof. The magnetic particles are granulated into a pulverized matter having a target particle size, and the volume average particle diameter is determined. The size of the grain boundary which is the base of the magnetic particles is controlled by the pulverized particle diameter subsequent to the pre-firing. Further, the balance between the surface unevenness and the BET specific surface area is achieved through minute adjustment of the surface unevenness using $SiO_2$ or $SrCO_3$ as an additive. The surface unevenness may be adjusted such that the area of the grain boundary is widened and the unevenness average interval Sm becomes large when $SiO_2$ is added. $SrCO_3$ increases the arithmetic surface roughness Ra when added.

Next, firing of the particles performed, the temperature and the oxygen concentration thereof are adjusted, and magnetization is applied to the particles to beset as ferrite. The size of the entirety of grain boundaries are adjusted by the firing temperature and the oxygen concentration. The unevenness average interval Sm is likely to be increased when the firing temperature is high and the arithmetic surface roughness Ra is likely to be increased when the oxygen concentration is high. Further, the firing temperature and the oxygen concentration strongly affect the resistance and the magnetization. The magnetization becomes higher and the resistance becomes lower as the temperature becomes higher and the oxygen concentration becomes lower.

Ferritization is performed after the firing is terminated, and the internal voids are reduced at a temperature of the degree that a ferritization reaction does not occur. In this manner, the target magnetic particles may be obtained. When the temperature is changed during fluidization, since the intervals between grain boundaries are reduced, it is possible to reduce the BET specific surface area without substantially changing the unevenness average interval Sm and the arithmetic surface roughness Ra.

Hereinafter, an example of the method of producing magnetic particles according to the present exemplary embodiment will be described by presenting specific materials and conditions, but the magnetic particles according to the present exemplary embodiment are not limited to the materials or numerical values described below.

For example, $Fe_2O_3$, $Mn(OH)_2$, and $Mg(OH)_2$ are mixed such that the molar ratio thereof becomes 2:0.8:0.2, 0.1% by weight of $SiO_2$ with respect to the total weight is added, and the mixture is further mixed. Next, a dispersant and water are added thereto and the mixture is mixed and pulverized using zirconia beads having a media diameter of 1 mm. Subsequently, water is dried, and pre-firing is performed at a temperature of 900° C.

In the electrostatic charge image developing carrier according to the present exemplary embodiment, the magnetic particles preferably contain at least one of Mn and Mg.

The above-described pre-fired product is mixed and pulverized together with a dispersant, water, and polyvinyl alcohol as a binder resin using a wet ball mill. The pulverization is stopped at the time when the particle diameter of the pulverized particles becomes 1.2 μm in terms of volume average particle diameter.

Next, granulation and drying are performed using a spray dryer such that the pulverized particles become particles, having a volume average particle diameter of 28 μm.

The dried particles are fired in an electric furnace at 1240° C. such that the oxygen concentration thereof is adjusted to be 1% in a mixed gas of oxygen and nitrogen.

Subsequent to the ferrite particles having a volume average particle diameter of 35 μm are obtained through a crushing process and a classifying process. Further, the ferrite particles are heated at 900° C. under the condition of 15 ppm using a rotary kiln.

When the heated particles are subjected to the crushing process and the classifying process again, the target magnetic particles having a particle diameter of 26 μm may be obtained.

The carrier according to the present exemplary embodiment may be formed of only magnetic particles or may be a coated carrier having magnetic particles whose surface is coated with a resin in at least a portion thereof.

Examples of the resin (coating resin) to be applied to the magnetic particles include polyethylene, polypropylene, polystyrene, polyvinyl acetate, polyvinyl alcohol, polyvinyl butyral, polyvinyl chloride, polyvinyl ether, polyvinyl ketone, a vinyl-chloride-vinyl acetate copolymer, a styrene-acrylic acid copolymer, a cyclohexyl acrylate resin, a cyclohexyl methacrylate resin, a straight silicone resin having an organosiloxane bond or a modified product thereof, a fluorine resin, polyester, polycarbonate, a phenol resin, and an epoxy resin.

The coating resin may contain other additives such as a conductive material and the like.

Examples of the conductive material include carbon black, various metal powder, and metal oxides such as titanium oxide, tin oxide, magnetite, or ferrite. These may be used alone or in combination of two or more kinds thereof. Among these, in terms of excellent production stability, low cost, and excellent conductivity, carbon black particles are preferable. The kind of carbon black is not particularly limited, but carbon black whose DBP oil absorption amount is in the range of 50 mL/100 g to 250 mL/100 g is preferable in terms of excellent production stability.

Examples of the method of coating the surface of magnetic particles with a coating resin include a method of coating the surface thereof with a coating resin or a solution for forming a coating layer obtained by dissolving various additives in an appropriate solvent according to the necessity. The solvent is not particularly limited and may be selected in consideration of a coating resin to be used, coating suitability, and the like.

Specific examples of the method of coating the surface with a resin include a dipping method of dipping magnetic particles in a solution for forming a coating layer; a spray method of spraying a solution for forming a coating layer to the surface of a core; a fluidized bed method of spraying a solution for forming a coating layer in a state in which magnetic particles are floated due to a fluidized air; and a kneader coater method of mixing magnetic particles of the carrier with a solution for a coating layer in a kneader coater and removing the solvent.

Here, the coating amount of the coating rein layer with respect to the magnetic particles may be 0.5% by weight (preferably in the range of 0.7% by weight to 6% by weight and more preferably in the range of 1.0% by weight to 5.0% by weight) with respect to the total weight of entire carrier.

In a case of the carrier, when the coating amount of the coating resin layer with respect to the magnetic particles is 6% by weight or less, the surface shape (the unevenness average interval Sm of the surface, the arithmetic surface roughness Ra of the surface, the BET specific surface area A, and the volume average particle diameter D50v) of the carrier is maintained to the surface shape of the magnetic particles.

The coating amount of the coating layer is determined as follows.

In a case of a solvent-soluble coating layer, a predetermined amount of carrier is dissolved in a soluble solvent (for example, toluene), magnetic particles are held by a magnet, and the solution in which the coating layer is dissolved is washed away. By repeating this process several times, magnetic particles from which the coating layer is removed remain. The coating amount of the coating layer is calculated by drying the magnetic particles, measuring the weight of the magnetic particles, and dividing the difference by the carrier amount.

Specifically, 20.0 g of a carrier is weighed, the weighed carrier is put into a beaker, 100 g of toluene is added thereto, and the mixture is stirred by a stirring blade for 10 minutes. A magnet is brought into contact with the bottom of the beaker and toluene is allowed to flow therein such that the core (magnetic particles) do not flow out of the beaker. This process is repeated our times and the beaker after washed away is dried. A magnetic particle amount after the beaker is dried is measured and the coating amount is calculated using a formula [(carrier amount−the amount of magnetic particles after the solution is washed)/carrier amount].

In contrast, in a case of a solvent-insoluble coating layer, the layer is heated in a temperature range of room temperature (25° C.) to 1000° C. using THERMO PLUS EVOII differential type differential thermal balance TG8120 (manufactured by Rigaku Corporation) under a nitrogen atmosphere and the coating amount is calculated from a decrease in weight thereof.

Electrostatic Charge Image Developer

The electrostatic charge image developer (hereinafter, referred to as a developer) according to the present exemplary embodiment includes a toner for developing an electrostatic charge image and the electrostatic charge image developing carrier described above.

The toner included in the developer according to the present exemplary embodiment includes toner particles and an additive according to the necessity.

Toner Particles

The toner particles contain, for example, a binder resin, a coloring agent, a release agent, and other additives according to the necessity.

Binder Resin

Examples of the binder resin include a vinyl resin formed of a homopolymer of monomers such as styrenes (for example, styrene, parachlorostyrene and α-methylstyrene); (meth)acrylic acid esters (for example, acrylic acid methyl and acrylic acid ethyl, acrylic acid n-propyl, acrylic acid n-butyl, acrylic acid lauryl, acrylic acid 2-ethylhexyl, methacrylic acid methyl, methacrylic acid ethyl, methacrylic acid n-propyl, methacrylic acid lauryl, and methacrylic acid 2-ethylhexyl); ethylenically unsaturated nitriles (for example, acrylonitrile and methacrylonitrile); vinyl ethers (for example, vinyl methyl ether and vinyl isobutyl ether); vinyl ketones (vinyl methyl ketone, vinyl ethyl ketone, and vinyl isopropenyl ketone); and olefins (for example, ethylene, propylene, and butadiene) or a copolymer combining two or more kinds of these monomers.

Examples of the binder resin also include a non-vinyl resin such as an epoxy resin, a polyester resin, a polyurethane resin, a polyamide resin, a cellulose resin, a polyether resin, or a modified rosin; a mixture of these and the vinyl resin; and a graft polymer obtained by polymerizing vinyl monomers in the coexistence of these.

These binder resins may be used alone or in combination of two or more kinds thereof.

The content of the binder resin is preferably in the range of 40% by weight to 95% by weight, more preferably in the range of 50% by weight to 90% by weight, and still more preferably in the range of 60% by weight to 85% by weight with respect to the entirety of toner particles.

—Colorants—

Examples of colorants include various pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazole dye.

These colorants may be used alone or in combination of two or more kinds thereof.

As the colorant, a colorant subjected to a surface treatment may be used according to the necessity or combination with a dispersant may be used. In addition, the colorants may be used in combination of plural kinds thereof.

The content of the colorant is preferably in the range of 1% by weight to 30% by weight and more preferably in the range of 3% by weight to 15% by weight with respect to the entirety of toner particles.

—Release Agent—

Examples of the release agent include natural waxes such as a hydrocarbon wax, a carnauba wax, a rice wax, and a candelilla wax; synthetic or mineral and petroleum waxes such as a montan wax; and ester waxes such as fatty acid ester and montan acid ester. However, the release agents are not limited to these examples.

The melting temperature of the release agent is preferably in the range of 50° C. to 110° C. and more preferably in the range of 60° C. to 100° C.

Further, the melting temperature is obtained from "melting peak temperature" described in a method of obtaining the melting temperature in JIS K-1987 "Method of Measuring Transition Temperature of Plastic" based on a DSC curve obtained using differential scanning calorimetry (DSC).

The content of the release agent is preferably in the range of 1% by weight to 20% by weight and more preferably in the range of 5% by weight to 15% by weight with respect to the entirety of toner particles.

—Other Additives—

Examples of other additives include known additives such as a magnetic material, a charge-controlling agent, and inorganic particles. These additives are contained in toner particles as internal additives.

—Characteristics of Toner Particles—

The toner particles may have a single layer structure or a so-called core-shell structure formed of a core (core particles) and a coating layer (shell layer) covering the core.

Here, the toner particles having a core-shell structure may be formed of a core containing a binder resin and other additives such as a coloring agent and a release agent according to the necessity; and a coating layer containing a binder resin.

The volume average particle diameter (D50v) of the toner particles is preferably in the range of 2 μm to 10 μm and more preferably in the range of 4 μm to 8 μm.

In addition, various average particle diameters and various particle size distribution indices of toner particles are measured using COULTER MULTISIZER-II (manufactured by BECKMAN COULTER) and an electrolyte solution is measured using ISOTON-II (manufactured by BECKMAN COULTER).

During the measurement, as a dispersant, a measurement sample is added to 2 mL of a 5% aqueous solution of a surfactant (sodium alkylbenzene sulfonate is preferable) by an amount of 0.5 mg to 50 mg. The solution is added to 100 mL to 150 mL of an electrolyte solution.

The electrolyte in which the sample is suspended is subjected to a dispersion treatment in an ultrasonic disperser for 1 minute, and the particle size distribution of particles having a particle diameter in the range of 2 μm to 60 μm is measured using an aperture having an aperture diameter of 100 μm with COULTER MULTISIZER-II. Further, the number of particles for sampling is 50000.

Cumulative distributions of the volume and the number are drawn from the small diameter side with respect to the particle size range (channel) divided based on the measured particle size distribution, and the particle diameter corresponding to 16% cumulation is defined as a volume particle diameter D16v and a number particle diameter D16p, the particle diameter corresponding to 50% cumulation is defined as a volume average particle diameter D50v and a number average particle diameter D50p, and the particle diameter corresponding to 84% cumulation is defined as a volume particle diameter D84v and a number particle diameter D84p.

Using these definitions, the volume average particle size distribution index (GSDv) is calculated as $(D84v/D16v)^{1/2}$ and the number average particle size distribution index (GSDp) is calculated as $(D84p/D16p)^{1/2}$.

A shape factor SF1 of the toner particles is preferably in the range of 110 to 150 and more preferably in the range of 120 to 140.

In addition, the shape factor SF1 is determined by the following equation.

$$SF1=(ML^2/A)\times(\pi/4)\times 100 \quad \text{Equation:}$$

In the equation, ML represents a maximum absolute length of a toner and A represents a protected area of a toner.

Specifically, the shape factor SF1 is digitized by mainly analyzing a microscope image or a scanning electron microscope (SEM) image using an image analyzer and is calculated as follows. That is, an optical microscope image of particles sprayed on the surface of slide glass is captured in an image analyzer (Luzex) by a video camera, the maximum length and the projected area of one hundred particles are obtained, and calculation is performed using the above equation, and then the average value thereof is obtained, thereby obtaining the shape factor.

External Additives

As the external additive, inorganic particles are exemplified. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3$, $2SiO_2$, $CaCO_3$, $MgCO_3$, $BaSO_4$, and $MgSO_4$.

The surface of Inorganic particles as an external additive may be subjected to a hydrophobizing treatment. The hydrophobizing treatment is performed by dipping the inorganic particles in a hydrophobizing agent. The hydrophobizing agent is not particularly limited, and examples thereof include a silane coupling agent, silicone oil, a titanate coupling agent, and an aluminum coupling agent. These may be used alone or in combination of two or more kinds thereof.

The amount of the hydrophobizing agent is generally in the range of 1 part by weight to 10 parts by weight with respect to 100 parts by weight of the inorganic particles.

Examples of the external additive include resin particles (resin particles such as polystyrene, PMMA, and a melamine resin) and cleaning aids (metal salts of higher fatty acids represented by zinc stearate and particles of a fluorine polymer).

The amount of the external additive is preferably in the range of 0.01% by weight to 5% by weight and more preferably in the range of 0.01% by weight to 2.0% by weight with respect to toner particles.

Method of Producing Toner

Next, a method of producing a toner according to the present exemplary embodiment will be described.

The toner according to the present exemplary embodiment may be obtained by adding an external additive to toner particles after the toner particles are produced.

The toner particles may be produced using a dry method (for example, a kneading and pulverizing method) or a wet method (for example, an aggregation and unification method, a suspension polymerization method, or a dissolution suspension method). The method of producing toner particles is not particularly limited, and a known method is employed.

Among these, the toner particles may be obtained using an aggregation and coalescence method.

Further, the toner according to the present exemplary embodiment is produced by adding an external additive to the obtained toner particles in a dry state and mixing the mixture. The mixing may be performed using a V blender, a HENSCHEL mixer, or a Redige mixer. Further, coarse particles of the toner may be removed using a vibration sieve or a wind classifier if necessary.

In addition, a mixing ratio (weight ratio) of the toner to the carrier in the developer according to the present exemplary embodiment is preferably in the range of 1:100 to 30:100 and more preferably in the range of 3:100 to 20:100.

Image Forming Apparatus/Image Forming Method

An image forming apparatus and an image forming method according to the present exemplary embodiment will be described.

The image forming apparatus according to the present exemplary embodiment includes an image holding member; a charging unit that charges the surface of the image holding member; an electrostatic charge image forming unit that forms an electrostatic charge image on the surface of a charged image holding member; a developing unit that accommodates an electrostatic charge image developer and develops the electrostatic charge image formed on the surface of the image holding member as a toner image using the electrostatic charge image developer; a transfer unit that transfers the toner image formed on the surface of the image holding member to the surface of a recording medium; and a fixing unit that fixes the toner image transferred to the surface of the recording medium. In addition, the electrostatic charge image developer according to the present exemplary embodiment is applied as an electrostatic charge image developer.

The image forming method according to the present exemplary embodiment is an image forming method (image forming method according to the present exemplary embodiment) including a charging process of charging the surface of the image holding member; an electrostatic charge image forming process of forming an electrostatic charge image on the surface of a charged image holding member; a developing process of developing the electrostatic charge image formed on the surf ace of the image holding member as a toner image using the electrostatic charge image developer according to the present exemplary embodiment; a transfer process of transferring the toner image formed on the surface of the image holding member to the surface of a recording medium; and a fixing process of fixing the toner image transferred to the surface of the recording medium.

Examples of the image forming apparatus according to the present exemplary embodiment include known image forming apparatuses such as an apparatus having a direct transfer system of directly transferring a toner image formed on a surface of an image holding member to a recording medium; an apparatus having an intermediate transfer system of primarily transferring a toner image formed on a surface of an image holding member to a surface of an intermediate transfer member and then secondarily transferring the toner image transferred to the surface of the intermediate transfer member to a surface of a recording medium; an apparatus including a cleaning unit that performs cleaning of a surface of an image holding member before charging and after transferring a toner image; and an apparatus including an erasing unit that erases the charge by irradiating a surface of an image holding member with erasing light before charging and after transferring a toner image.

In the case of the apparatus having an intermediate transfer system, the transfer unit has a configuration including an intermediate transfer member in which a toner image is transferred to a surface; a primary transfer unit that primarily transfers the toner image formed on a surface of an image holding member to the surface of the intermediate transfer member; and a secondary transfer unit that secondarily transfers the toner image transferred to the surface of the intermediate transfer member to the surface of the recording medium.

In addition, in the image forming apparatus according to the present exemplary embodiment, a portion including the developing unit may have a cartridge structure (process cartridge) which is detachable from the image forming apparatus. As the process cartridge, a process cartridge accommodating the electrostatic charge image developer according to the present exemplary embodiment and including the developing unit is preferably used.

Hereinafter, an example of the image forming apparatus according to the present exemplary embodiment will be described, but the present invention is not limited thereto. In addition, main elements illustrated in the figures are described and description of other elements is omitted.

FIG. 1 is a view schematically illustrating the configuration of the image forming apparatus according to the present exemplary embodiment.

The image forming apparatus illustrated in FIG. 1 includes first to fourth image forming units 10Y, 10M, 10C, and 10K (image forming units) having an electrophotographic system of outputting images of respective colors of yellow (Y) magenta (M), cyan (C) and black (K) based on color-separated image data. These image forming units (hereinafter, simply referred to as "units" in some cases) 10Y, 10M, 10C, and 10K are disposed in parallel in a state of being separated from one another by a predetermined distance in the horizontal direction. Further, these units 10Y, 10M, 10C, and 10K may be process cartridges that are detachable from the image forming apparatus.

On the upper side in the figure of respective units 10Y, 10M, 10C, and 10K, an intermediate transfer belt 20 is extended as an intermediate transfer member through the respective units. The intermediate transfer belt 20 is provided in a state of winding a driving roll 22 and a support roll 24 in contact with the inner surface of the intermediate transfer belt 20 which are arranged by being separated from each other in the horizontal direction of the figure, and travels toward the fourth unit 10K from the first unit 10Y. Moreover, in the support roll 24, a force is applied to a direction away from the driving roll 22 due to a spring or the like not illustrated) and tension is applied to the intermediate transfer belt 20 wound around the support roll and the driving roll. Further, an intermediate transfer member cleaning apparatus 30 is provided on the side surface of the image holding member of the intermediate transfer belt 20 so as to face the driving roll 22.

In addition, four toner colors, yellow, magenta, cyan, and black accommodated in toner cartridges 8Y, 8M, 8C, and 8K are supplied to respective developing devices (developing units) 4Y, 4K, 4C, and 4K of the respective units 10Y, 10M, 10C, and 10K.

Since the first to fourth units 10Y, 10M, 10C, and 10K have the same configuration, the first unit 10Y which is disposed on the upstream side of the intermediate transfer belt in a travelling direction and forms a yellow image will be described as a representative example. In addition, the description of the second to fourth units 10M, 10C, and 10K is omitted by denoting the reference numeral of magenta (M), cyan (C), or black (K) to a part equivalent to the first unit 10Y instead of yellow (Y).

The first unit 10Y includes a photoreceptor 1Y which is operated as an image holding member. A charging roll (an example of a charging unit) 2Y that charges the surface of the photoreceptor 1Y to a predetermined potential; an exposure device (an example of an electrostatic charge image forming unit) 3 that forms an electrostatic charge image by exposing the charged surface with laser light 3Y based on a color-separated image signal; a developing device (an example of a developing unit) 4Y that develops the electrostatic charge image by supplying a toner charging the electrostatic charge image; a primary transfer roll 5Y (an example of a primary transfer unit) that transfers a developed toner image onto the intermediate transfer belt 20; and a photoreceptor cleaning device (an example of a cleaning unit) 6Y that removes a toner remaining on the surface of the photoreceptor 1Y after the primary transfer is done are arranged around the photoreceptor 1Y in this order.

In addition, the primary transfer roll 5Y is arranged in the inside of the intermediate transfer belt 20 and provided in a position facing the photoreceptor 1Y. Further, bias power sources (not illustrated) applying primary transfer bias are respectively connected to each of the primary transfer rolls 5Y, 5M, 5C, and 5K. The respective bias power sources change the transfer bias applied to the respective primary transfer rolls through control of a control unit (not illustrated).

Hereinafter, an operation of forming a yellow image in the first unit 10Y will be described.

First, prior to the operation, the surface of the photoreceptor 1Y is charged to a potential of −600 V to −800 V by the charging roll 2Y.

The photoreceptor 1Y is formed by laminating a photosensitive layer on a conductive (for example, volume resistivity at 20° C.: $1\times10^{-6}$ Ω·cm or less) substrate. The photosensitive layer has high resistance (resistant to a normal resin) in general, but the photosensitive layer has a property in which specific resistance of a portion irradiated with laser light is changed when the portion is irradiated with laser light 3Y. For this reason, the layer light 3Y is output to the surface of the charged photoreceptor hi through the exposure device 3 according to image data for yellow transmitted from the control unit (not illustrated). The photosensitive layer on the surface of the photoreceptor 1Y is irradiated with the laser light 3Y, and accordingly, an electrostatic charge image of a yellow image pattern is formed on the surface of the photoreceptor 1Y.

The electrostatic charge image is an image formed on the surface of the photoreceptor 1Y through charging and is a so-called negative latent image formed when the specific resistance on the portion of the photosensitive layer not being irradiated with the laser light 3Y is decreased, the charge charging the surface of the photoreceptor 1Y flows, and the charge of the portion not irradiated with the laser light 3Y remains.

The electrostatic charge image formed on the photoreceptor 1Y is rotated to a predetermined developing position according to travelling of the photoreceptor 1Y. In addition, the electrostatic charge image on the photoreceptor 1Y is made into a visible image (developed image) as a toner image by the developing device 4Y in the developing position.

For example, an electrostatic charge image developer including at least a yellow toner and a carrier is accommodated in the developing device 4Y. The yellow toner is frictionally charged by being stirred in the inside of the developing device 4Y and is held on a developer roll (an example of a developer holding member) with a charge of the same polarity (negative polarity) as the charge charged on the photoreceptor 1Y. Further, when the surface of the photoreceptor 1Y passes through the developing device 4Y, the yellow toner is electrostatically adhered to a charge-removed latent image portion on the surface of the photoreceptor 1Y and a latent image is developed by the yellow toner. The photoreceptor 1Y on which a yellow toner image is formed continuously travels at a predetermined speed and the toner image developed on the photoreceptor 1Y is transported to a predetermined primary transfer position.

When the yellow toner image on the photoreceptor 1Y is transported to the primary transfer position, primary transfer bias applied to the primary transfer roll 5Y, the electrostatic force toward the primary transfer roll 5Y from the photoreceptor 1Y acts on the toner image, and the toner image on the photoreceptor 1Y is transferred onto the intermediate transfer belt 20. The transfer bias to be applied at this time is a positive (+) polarity which is an opposite polarity of the toner polarity (−) and is controlled to be +10 μA by a control unit (not illustrated) in the first unit 10Y.

In addition, a toner remaining on the photoreceptor 1Y is removed by the photoreceptor cleaning device 6Y to be collected.

In addition, the primary transfer bias to be applied to primary transfer rolls 5M, 5C, and 5K subsequent to the second unit 10M is controlled by the first unit.

In this manner, the intermediate transfer belt 20 to which a yellow toner image is transferred in the first unit 10Y is sequentially transported through the second to fourth units 10M, 10C, and 10K, and multiple toner images of respective colors, which are overlapped with each other, are transferred.

The intermediate transfer belt 20 to which four colors of multiple toner images are transferred by passing through the first to fourth units reaches the secondary transfer unit formed of the intermediate transfer belt 20, the support roll 24 in contact with the inner surface of the intermediate transfer belt, and a secondary transfer roll (an example of a secondary transfer unit) 26 arranged on the image holding surface side of the intermediate transfer belt 20. In addition, the recording sheet (an example of a recording medium) P is fed to a void in contact with the secondary transfer roll 26 and the intermediate transfer belt 20 through a supply mechanism at a predetermined timing, and the secondary transfer bias is applied to the support roll 24. The transfer bias to be applied at this time is the negative (−) polarity which is the same as the polarity (−) of a toner, the electrostatic force toward the recording sheet P from the intermediate transfer belt 20 acts on the toner image, and the toner image on the intermediate transfer belt 20 is transferred onto the recording sheet P. Further, the secondary transfer bias at this time is determined according to the resistance detected by resistance detecting unit (not illustrated) that detects the resistance of the secondary transfer unit and the voltage thereof is controlled.

Next, the recording sheet P is sent to a pressure-contact unit (nip portion) of a pair of fixing rolls in a fixing device (an example of a fixing unit) 28, the toner image is fixed onto the recording sheet P, and a fixed image is formed.

As the recording sheet P transferring a toner image, plain paper used in a copying machine having an electrophotographic system or a printer may be exemplified. As the recording medium, an OHP sheet may be exemplified in addition to the recording sheet P.

In order to improve smoothness of the surface of the fixed image, the surface of the recording sheet P is also preferably smooth, and coated paper obtained by coating the surface of plain paper with a resin or the like or art paper for printing is preferably used.

The recording sheet P in which fixation of a color image is completed is transported toward a discharge unit and a series of color image forming operations are terminated.

Process Cartridge/Developer Cartridge

A process cartridge according to the present exemplary embodiment will be described.

The process cartridge according to the present exemplary embodiment is a process cartridge that accommodates the electrostatic charge image developer according to the present exemplary embodiment, includes a developing unit developing an electrostatic charge image formed on the surface of the image holding member as a toner image by the electrostatic charge image developer, and is detachable from the image forming apparatus.

In addition, the process cartridge according to the present exemplary embodiment may have a configuration, which is not limited to the above-described configuration, including a developing device and at least one unit selected from other units of an image holding member, a charging unit, an electrostatic charge image forming unit, and a transfer unit according to the necessity.

Hereinafter, an example of the process cartridge according to the present exemplary embodiment will be described, but the present invention is not limited thereto. In addition, main elements illustrated in the figures are described and description of other elements is omitted.

Figure 2:
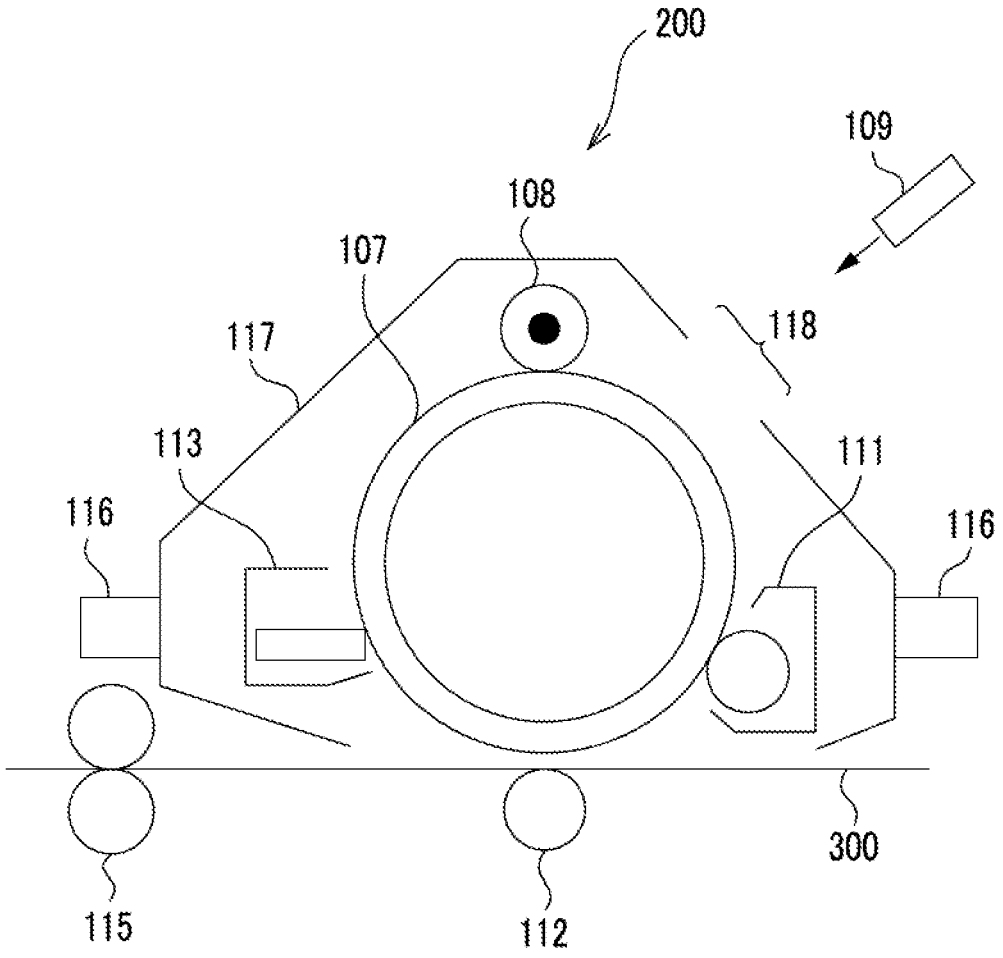
FIG. 2 is a view schematically illustrating an example of a configuration of a process cartridge according to the present exemplary embodiment.

FIG. 2 is a view schematically illustrating the configuration of the process cartridge according to the present exemplary embodiment.

A process cartridge 200 illustrated in FIG. 2 is configured by integrally combining and holding a photoreceptor 107 (an example of an image holding member), a charging roll 108 (an example of a charging unit) provided in the vicinity of the photoreceptor 107, a developing device 111 (an example of a developing unit), and a photoreceptor cleaning device 113 (an example of a cleaning unit) by a housing 117 including a mounting rail 116 and an opening portion 118 for exposure and made into a cartridge.

Further, in FIG. 2, the reference numeral 109 indicates an exposure device (an example of an electrostatic charge image forming unit), the reference numeral 112 indicates a transfer device (an example of a transfer unit), the reference numeral 115 indicates a fixing device (an example of a fixing unit), and the reference numeral 300 indicates recording sheet (an example of a recording medium).

Next, a developer cartridge according to the present exemplary embodiment will be described.

The developer cartridge according to the present exemplary embodiment is a developer cartridge that accommodates the developer according to the present exemplary embodiment and is detachable from the image forming apparatus.

For example, in the image forming apparatus illustrated in FIG. 1, toner cartridges 8Y, 8M, 8C, and 8K may be developer cartridges according to the present exemplary embodiment. In a case where developers accommodated in the cartridges become depleted, the cartridge is exchanged.

EXAMPLES

Hereinafter, the present exemplary embodiment will be described in detail based on Examples and Comparative Examples, but the invention is not limited to Examples below.

Further, "parts" indicates "parts by weight" unless otherwise noted.

Example 1

Preparation of Coating Liquid

Cyclohexyl acrylate resin (weight average molecular weight: 50000): 36 pars by weight Carbon black VXC72 (manufactured by Cabot Corporation): 4 parts by weight Toluene: 250 parts by weight Isopropyl alcohol: 50 parts by weight The above-described components and glass beads (particle diameter: 1 mm) with the same amount as that of toluene are put into a sand mill (manufactured by Kansai Paint Ltd.), and the mixture is stirred at a rotation speed of 1200 rpm for 30 minutes, thereby preparing a coating liquid having a solid content of 11% by weight.

Preparation of Magnetic Particles 1

1318 parts by weight of $Fe_2O_3$, 586 parts by weight of $Mn(OH)_2$, 96 parts by weight of $Mg(OH)_2$, and 1 part by weight of $SrCO_3$ are mixed with one another, polyvinyl alcohol as a dispersant, water, and zirconia beads having a media diameter of 1 mm are added thereto, and the mixture is crushed and mixed in a sand mill.

—Pre-Firing—

Next, zirconia beads are removed by filtration, and the mixture is dried and then heated under the conditions of 900° C. and at 20 rpm for 60 minutes using a rotary kiln, thereby obtaining mixed oxides.

—Pulverization of Slurry—

Subsequently, polyvinyl alcohol as a dispersant and water are added, and 6.6 parts by weight of polyvinyl alcohol is further added thereto, and then the mixture is pulverized using a wet ball mill until the volume average particle diameter thereof becomes 1.2 μm.

—Granulation—

Next, the mixture is granulated and dried using a spray dryer until the dried particle diameter becomes 28 μm.

—Main Firing—

Moreover, the mixture is fired in an electric furnace at 1240° C. for 5 hours under a mixing atmosphere of oxygen and nitrogen with an oxygen concentration of 1%.

—Additional Processes—

The obtained particles are subjected to a crushing process and a classifying process, and heated using a rotary kiln under the conditions of 900° C. and at 15 rpm for 2 hours, and then further subjected to the classifying process, thereby obtaining magnetic particles 1.

Preparation of Carrier 1

2000 g of magnetic particles 1 are put in a vacuum degassing 5 L kneader, 560 g of the coating liquid 1 is further added thereto, and the mixture is mixed for 15 minutes by reducing the pressure thereof to −200 mmHg at 60° C. while stirring, and then the mixture is stirred and stirred for 30 minutes under the conditions of 94° C. and −720 mmHg by increasing the temperature thereof and reducing the pressure thereof, thereby obtaining resin-coated particles. Next, sieving is performed using a sieving net having a mesh of 75 μm, thereby obtaining a carrier 1.

The coating amount of the carrier 1 with respect to the magnetic particles of the coating resin layer is 3.5% by weight.

Examples 2 to 10 and Comparative Examples 1 to 8

Preparation of Magnetic Particles 2 to 18

Magnetic particles 2 to 18 are respectively prepared in the same manner as that of the particles 1 except that the production conditions in production of the magnetic particles 1 are changed as listed in Table 1.

The constituent materials and production conditions of prepared magnetic particles are listed in Table 1.

TABLE 1

| | Weight ratio of constituent materials | | | | | Pre-firing | Pulverization of slurry | Granulation Dried | Main firing | | Additional processes |
|---|---|---|---|---|---|---|---|---|---|---|---|
| | $Fe_2O_3$ | $Mn(OH)_2$ | $Mg(OH)_2$ | $SiO_2$ | $SrCO_3$ | Temperature (° C.) | Crushed particle diameter (μm) | particle diameter (μm) | Temperature (° C.) | Oxygen concentration (%) | Temperature (° C.) |
| Magnetic particles 1 | 1318 | 586 | 96 | 0.0 | 1.0 | 900 | 1.2 | 28 | 1240 | 1.0 | 900 |
| Magnetic particles 2 | 1318 | 586 | 96 | 1.2 | 0.0 | 900 | 1.4 | 28 | 1200 | 1.0 | 900 |
| Magnetic particles 3 | 1318 | 586 | 96 | 0.0 | 1.2 | 950 | 1.0 | 28 | 1250 | 0.8 | 940 |
| Magnetic particles 4 | 1318 | 586 | 96 | 1.5 | 0.0 | 900 | 1.2 | 28 | 1220 | 1.1 | 900 |
| Magnetic particles 5 | 1318 | 586 | 96 | 0.0 | 1.0 | 920 | 1.0 | 28 | 1240 | 1.0 | 920 |
| Magnetic particles 6 | 1318 | 586 | 96 | 1.5 | 1.0 | 900 | 1.6 | 28 | 1200 | 1.2 | 900 |
| Magnetic particles 7 | 1318 | 586 | 96 | 0.0 | 1.0 | 920 | 1.0 | 28 | 1260 | 0.9 | 940 |

TABLE 1-continued

| | Weight ratio of constituent materials | | | | | Pre-firing | Pulverization of slurry | Granulation Dried | Main firing | | Additional processes |
|---|---|---|---|---|---|---|---|---|---|---|---|
| | $Fe_2O_3$ | $Mn(OH)_2$ | $Mg(OH)_2$ | $SiO_2$ | $SrCO_3$ | Temperature (° C.) | Crushed particle diameter (μm) | particle diameter (μm) | Temperature (° C.) | Oxygen concentration (%) | Temperature (° C.) |
| Magnetic particles 8 | 1318 | 586 | 96 | 1.0 | 0.0 | 900 | 1.2 | 34 | 1230 | 1.0 | 900 |
| Magnetic particles 9 | 1318 | 586 | 96 | 0.0 | 1.5 | 900 | 1.0 | 20 | 1250 | 1.0 | 920 |
| Magnetic particles 10 | 1318 | 586 | 96 | 1.5 | 0.0 | 900 | 1.8 | 28 | 1220 | 1.0 | 0 |
| Magnetic particles 11 | 1318 | 586 | 96 | 0.0 | 1.2 | 950 | 0.8 | 28 | 1260 | 0.8 | 980 |
| Magnetic particles 12 | 1318 | 586 | 96 | 1.0 | 0.0 | 900 | 1.6 | 28 | 1230 | 1.2 | 0 |
| Magnetic particles 13 | 1318 | 586 | 96 | 0.0 | 1.3 | 950 | 1.0 | 28 | 1260 | 0.8 | 960 |
| Magnetic particles 14 | 1318 | 586 | 96 | 1.2 | 0.0 | 900 | 1.6 | 28 | 1220 | 1.1 | 0 |
| Magnetic particles 15 | 1318 | 586 | 96 | 0.0 | 1.2 | 920 | 1.0 | 28 | 1280 | 0.8 | 1000 |
| Magnetic particles 16 | 1318 | 586 | 96 | 1.8 | 0.0 | 900 | 1.2 | 39 | 1230 | 1.0 | 920 |
| Magnetic particles 17 | 1318 | 586 | 96 | 0.0 | 1.8 | 900 | 1.0 | 17 | 1250 | 1.0 | 940 |
| Magnetic particles 18 | 1318 | 586 | 96 | 1.0 | 0.5 | 900 | 1.3 | 28 | 1250 | 0.9 | 920 |

Preparation of Carriers 2 to 18

Carriers 2 to 18 are prepared in the same manner as that of the carrier 1 except that the magnetic particles 1 are changed into magnetic particles 2 to 18 respectively in production of the carrier 1.

Measurement of Physical Properties of Magnetic Particles

In regard to the above-described prepared carriers 1 to 18, the unevenness average interval Sm of the surface of magnetic particles, the arithmetic surface roughness Ra of the surface thereof, the BET specific surface area A, and the volume average particle diameter D50v are respectively measured by the methods described below after a coating resin is removed as described below.

Removal of Coating Resin 20 g of the carrier is put into 100 mL of toluene. An ultrasonic wave is applied thereto under the condition of 40 kHz for 30 seconds. The magnetic particles and the resin solution are separated from each other using a filter paper adjusted to the particle diameter. 20 mL of toluene is allowed to flow into the magnetic particles remaining in the filter paper to be washed. Next, the magnetic particles remaining in the filter paper are collected. The collected magnetic particles are put into 100 mL of toluene in the same manner, an ultrasonic wave is applied thereto under the condition of 40 kHz for 30 seconds. Filtration is performed in the same manner, and the magnetic particles remaining in the filter paper are washed with 20 mL of toluene and then collected. This process is repeated 10 times. The finally collected magnetic particles are dried.

Unevenness Average Interval Sm of Surface and Arithmetic Average Roughness Ra of Surface The unevenness average interval Sm of the surface of magnetic particles and the arithmetic average roughness Ra of surface thereof are measured using a method of obtaining the values using a super-deep color 3D shape measuring microscope (VK-9500, manufactured by Keyence Corporation) at a magnification of 3000 times in terms of surface with respect to fifty magnetic particles.

In regard to the unevenness average interval Sm, roughness curve is obtained from the three-dimensional shape of the observed surface of magnetic particles, and an average value of the intervals of one mountain-valley cycle obtained from an intersection where the roughness curve intersects with the average line. The reference length at the time of obtaining the unevenness average interval Sm is 10 μm and the cutoff value is 0.08 mm.

The arithmetic average roughness Ra is determined by obtaining the roughness curve, summing the absolute values of deviation between the measured values and the average value of the roughness curve, and then averaging the obtained values. The reference length at the time of obtaining the arithmetic average toughness Ra is 10 μm and the cutoff value is 0.08 mm.

The measurement of the unevenness average interval Sm and the arithmetic average roughness Ra is performed in conformity with JIS B0601 (1994 edition).

Volume Average Particle Diameter D50v

The volume average particle diameter of magnetic particles is measured using a laser diffraction particle size distribution measuring device LA-700 (manufactured by Horiba, Ltd.).

Further, the particle diameter of the pulverized particles in the middle of producing the magnetic particles is measured in the same manner.

BET Specific Surface Area

The BET specific surface area of magnetic particles is measured by nitrogen substitution and a three-point method using an SA3100 specific surface area measuring device (manufactured by BECKMAN COULTER). Specifically, the measurement is performed by putting 5 g of magnetic particles into a cell and performing a degassing treatment at 60° C. for 120 minutes using a mixed gas (30:70) of nitrogen and helium.

The unevenness average intervals Sm of the surfaces of magnetic particles 1 to 18, the arithmetic surface roughnesses Ra of the surfaces thereof, the BET specific surface areas A, and the volume average particle diameters D50c are respectively listed in Table 2.

TABLE 2

| | Sm (μm) | Ra (μm) | BET specific surface area ($m^2/g$) | D50v (μm) |
|---|---|---|---|---|
| Magnetic particles 1 | 1.0 | 0.9 | 0.18 | 26 |
| Magnetic particles 2 | 2.5 | 1.0 | 0.19 | 26 |
| Magnetic particles 3 | 0.5 | 0.6 | 0.15 | 26 |
| Magnetic particles 4 | 1.8 | 1.2 | 0.19 | 26 |
| Magnetic particles 5 | 0.8 | 0.3 | 0.16 | 26 |
| Magnetic particles 6 | 2.0 | 1.0 | 0.20 | 26 |
| Magnetic particles 7 | 0.8 | 0.5 | 0.14 | 26 |
| Magnetic particles 8 | 1.5 | 1.0 | 0.16 | 32 |
| Magnetic particles 9 | 0.9 | 0.6 | 0.19 | 18 |
| Magnetic particles 10 | 3.5 | 1.0 | 0.20 | 26 |
| Magnetic particles 11 | 0.1 | 0.4 | 0.14 | 26 |
| Magnetic particles 12 | 2.3 | 2.0 | 0.19 | 26 |
| Magnetic particles 13 | 0.6 | 0.1 | 0.14 | 26 |
| Magnetic particles 14 | 2.4 | 1.0 | 0.28 | 26 |
| Magnetic particles 15 | 0.6 | 0.5 | 0.10 | 26 |
| Magnetic particles 16 | 1.6 | 1.1 | 0.15 | 36 |
| Magnetic particles 17 | 0.8 | 0.5 | 0.19 | 15 |
| Magnetic particles 18 | 1.0 | 0.9 | 0.14 | 26 |

Preparation of Toner 1

Colorant Particle Dispersion 1

Cyan pigment:copper phthalocyanine B15:3 (manufactured by Dainichiseika Color & Chemicals Mfg. Co., Ltd.): 50 parts Anionic surfactant: NEOGEN SC (manufactured by Daiichi Kogyo Seiyaku Co., Ltd.): 5 parts Ion exchange water: 200 parts The above-described components are mixed, dispersed by ULTRA-TURRAX (manufactured by IKA, Inc.) for 5 minutes, and further dispersed by an ultrasonic bath for 10 minutes, thereby obtaining a colorant particle dispersion 1 having a solid content of 21% by weight. When the volume average particle diameter is measured using a particle size measuring instrument LA-700 (manufactured by Horiba, Ltd.), the value is 160 nm.

Release Agent Dispersion 1

Paraffin wax: HNP-9 (manufactured by Nippon Seiro Co., Ltd.): 19 parts

Anionic surfactant: NEOGEN SC (manufactured by Daiichi Kogyo Seiyaku Co., Ltd.): 1 part Ion exchange water: 80 parts The above-described components are mixed in a heat-resistant container and stirred for 30 minutes by increasing the temperature therein to 90° C. Next, the melt from the bottom portion of the container is circulated to a GAULIN homogenizer, a circulation operation corresponding to three passes is performed under the condition of a pressure of 5 MPa, the pressure is increased to 35 MPa, and then the circulation operation corresponding to three paths is further performed. The temperature of an emulsified liquid obtained in this manner is cooled to lower than or equal to 40° C. in the heat-resistant container, thereby obtaining a release agent particle dispersion 1. When the volume average particle diameter is measured using a particle size measuring instrument LA-700 (manufactured by Horiba, Ltd.), the value is 240 nm.

Resin Particle Dispersion 1

—Oil Layer—

Styrene (manufactured by Wako Pure Chemical Industries, Ltd.): 30 parts

Acrylic acid n-butyl (manufactured by Wake Pure Chemical Industries, Ltd.): 10 parts β-carboxyethyl acrylate (manufactured by Rhodia Nikka, Ltd.): 1.3 parts Dodecane thiol (manufactured by Wake Pure Chemical Industries, Ltd.): 0.4 parts Water Layer 1

Ion exchange water: 17 parts

Anionic surfactant (DAWFAX, manufactured by Dow Chemical Company): 0.4 parts

Water Layer 2

Ion exchange water: 40 parts

Anionic surfactant (DAWFAX, manufactured by Dow Chemical Company): 0.05 parts

Ammonium peroxodisulfate (manufactured by Wako Pare Chemical Industries, Ltd.): 0.4 parts The components of the oil layer and the components of the water layer 1 are put into a flask and stirred and mixed with each other to be set as a monomer emulsified dispersion. The components of the water layer 2 are put into a reaction container, the inside of the container is substituted with nitrogen, and the reaction system is heated to 75° C. using an oil bath while stirring. The above-described monomer emulsified dispersion is gradually added dropwise to the container for 3 hours, and emulsion polymerization is performed. Polymerization is further continued at 75° C. after dropwise addition and then terminated after 3 hours.

When the volume average particle diameter D50v of the obtained resin particles is measured using a laser diffraction particle size distribution measuring device LA-700 (manufactured by Horiba, Ltd.), the value is 250 nm. Further, when the glass transition point at a temperature rising rate of 10° C./min is measured using a differential scanning calorimeter (DSC-50, manufactured by Shimadzu Corporation), the temperature is 53° C. Further, when the number average molecular weight (in terms of polystyrene) is measured by a molecular weight measuring instrument (HLC-8020 manufactured by Tosoh Corporation) using THF as a solvent, the value is 13000. In this manner, a resin particle dispersion 1 having a volume average particle diameter of 250 nm, a solid content of 42% by weight, a glass transition point of 52° C., and a number average molecular weight Mn of 13000 is obtained.

Preparation of Toner 1

Resin particle dispersion 1: 150 parts

Colorant particle dispersion 1: 30 parts

Release agent particle dispersion 1: 40 parts.

Polyaluminum chloride: 0.4 parts

The above-described components are mixed and dispersed using ULTRA-TURRAX (manufactured by IKA, Inc.) in a stainless steel flask, and heated to 40° C. while the components in the flask are stirred with an oil bath for heating. The mixture is held at 48° C. for 80 minutes and 70 parts by weight of the resin particle dispersion 1 is gradually added thereto.

Next, the pH in the system is adjusted to 6.0 using an aqueous sodium hydroxide solution having a concentration of 0.5 mol/L, the stainless steel flask is sealed, a seal of a stirring shaft is magnetically sealed, the flask is heated to 97° C. while stirring is continued, and then the flask is held for 3 hours. After the reaction is terminated, the resultant is cooled at a cooling rate of 1° C./min, filtered, sufficiently washed with ion exchange water and solid-liquid separation is performed by Nutsche suction filtration. The resultant is re-dispersed using 3 L of ion exchange water at 40° C., stirred at 300 rpm for 15 minutes, and then washed. The washing operation is repeatedly performed 5 times and solid-liquid separation is performed by Nutsche suction filtration using filter paper No. 5A when the pH of the filtrate becomes 6.54 and the electric conductivity becomes 6.5 μS/cm. Next, vacuum drying is continued for 12 hours and toner particles are obtained.

When the volume average particle diameter D50v of the toner particles is measured using a COULTER COUNTER, the value is 6.2 μm and the volume average particle size distribution index GSDv is 1.20. When the shape thereof is observed using a LUZEX IMAGE ANALYZER (manufactured by Luzex, Inc.), the shape factor SF1 of the particles is 135 and the shape thereof is a potato.

The glass transition point of the toner particles is 52° C.

In addition, silica ($SiO_2$) particles which are subjected to a surface hydrophobizing treatment using hexamethyldisilazane (hereinafter, referred to as "HMDS" in some cases) and have a primary particle average particle diameter of 40 nm and metatitanic acid compound particles which are products obtained by reacting metatitanic acid and isobutyltrimethoxysilane and have a primary particle average particle diameter of 20 nm are added to the toner particles such that the coverage with respect to the surface of the toner particles becomes 40%, and the mixture is mixed with a Henschel mixer, thereby preparing a toner 1.

Preparation of Toner 2

A toner 2 is prepared in the same manner as that of the toner 1 except that silica particles are changed into silica ($SiO_2$) particles, in the preparation of the toner 1, which are subjected to a surface hydrophobizing treatment using HMDS and have a primary particle average particle diameter of 20 nm and silica particles and metatitanic acid compound particles are added such that the coverage with respect to the surface of the toner particles becomes 70%.

Evaluation

A modified machine of DCC400 is adjusted such that the print speed thereof becomes 90 sheets/min. Next, the carrier 1 and the toner 1 are mixed with each other such that the toner concentration becomes 9% by weight, put in a Cyan position, and left alone in an environment of a temperature of 30° C. and a relative humidity (RH) of 88% for 24 hours, and then 10000 sheets of full solid images (image concentration: 100%) of A4 size are formed. Next, one sheet of full solid image having a dimension of 20 $cm^2$ is formed, and then concentration unevenness is evaluated by visually inspecting the image (generation of fogging) and measuring the color difference (ΔE). The evaluation is performed based on the following criteria.

The color difference (ΔE) is measured using a reflection densitometer X-RITE939 (manufactured by X-rite, Inc.).

The color difference (ΔE) is a square root value of the sum of squares of a distance difference in a L*a*b* space of CIE1976 (L*a*b*) color system. The CIE1976 (L*a*b*) color system is a color space recommended by CIE (International Commission on Illumination) in 1976 and defined in "JIS Z 8729" by Japanese Industrial Standards.

Color Difference

A: $\Delta E \leq 1.0$
B: $1 < \Delta E \leq 2$
C: $2 < \Delta E \leq 4$
D: $4 < \Delta E \leq 5$
E: $\Delta E > 5$ Fogging A: No fogging found when inspected visually or using a 25 times magnifier.
B: No fogging found when inspected visually.
C: Fogging is slightly found when inspected visually.
D: Fogging is thinly generated throughout the image when inspected visually.
E: Fogging is apparently generated throughout the image.

In Example 1 in which the carrier 1 is used, is not recognized in the image when visually inspected and the color difference ΔE is 0.5, which is excellent.

Full solid images are formed in the same manner as that of Example 1 except that the carrier 1 in Example 1 is changed into a carrier listed in Table 3 below, and evaluation is performed.

Example 11

Images are formed in the same manner as that of Example 1 except that a developer in which the carrier 1 is changed into the carrier 19 which is not coated with a resin with respect to the magnetic particles 1 and the toner 1 is changed into the toner 2 is used, and then evaluation is performed.

Comparative Example 9

Images are formed in the same manner as that of Example 1 except that a developer in which the carrier 1 is changed into the carrier 20 which is not coated with a resin with respect to the magnetic particles 11 and the toner 1 is changed into the toner 2 is used, and then evaluation is performed.

The evaluation results of Examples and Comparative Examples are listed in Table 3.

TABLE 3

| | Carrier in use | | | | Color difference (ΔE) | |
|---|---|---|---|---|---|---|
| | Number of carrier | Magnetic particles | Toner in use | Evaluation of fogging | Measured value | Evaluation |
| Example 1 | 1 | 1 | 1 | A | 0.5 | A |
| Example 2 | 2 | 2 | 1 | B | 1.2 | B |
| Example 3 | 3 | 3 | 1 | B | 2.0 | B |
| Example 4 | 4 | 4 | 1 | B | 2.0 | B |
| Example 5 | 5 | 5 | 1 | B | 1.8 | B |
| Example 6 | 6 | 6 | 1 | C | 3.8 | C |
| Example 7 | 7 | 7 | 1 | B | 1.0 | A |
| Example 8 | 8 | 8 | 1 | C | 2.0 | B |
| Example 9 | 9 | 9 | 1 | B | 4.0 | C |
| Example 10 | 18 | 18 | 1 | C | 2.0 | B |
| Example 11 | 19 | 1 | 2 | B | 2.0 | B |
| Comparative Example 1 | 10 | 10 | 1 | D | 4.5 | D |
| Comparative Example 2 | 11 | 11 | 1 | E | 6.0 | E |
| Comparative Example 3 | 12 | 12 | 1 | D | 5.5 | E |
| Comparative Example 4 | 13 | 13 | 1 | E | 4.0 | D |
| Comparative Example 5 | 14 | 14 | 1 | D | 6.0 | E |
| Comparative Example 6 | 15 | 15 | 1 | D | 4.5 | D |
| Comparative Example 7 | 16 | 16 | 1 | E | 4.8 | D |
| Comparative Example 8 | 17 | 17 | 1 | D | 4.6 | D |
| Comparative Example 9 | 20 | 11 | 2 | E | 5.5 | E |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising magnetic particles, wherein the magnetic particles have an unevenness average interval Sm of a surface, an arithmetic surface roughness Ra of a surface, a BET specific surface area A, and a volume average particle diameter D50v satisfying the following expressions (1) to (4):

$$0.5\ \mu m \leq Sm \leq 2.5\ \mu m \quad (1)$$

$$0.3\ \mu m \leq Ra \leq 1.2\ \mu m \quad (2)$$

$$0.14\ m^2/g \leq A \leq 0.20\ m^2/g \quad (3)$$

$$18\ \mu m \leq D50v \leq 32\ \mu m, \quad (4)$$

wherein the magnetic particles contain at least $SiO_2$ or $SrCO_3$.

2. The electrostatic charge image developing carrier according to claim 1, wherein the magnetic particles are ferrite particles.

3. The electrostatic charge image developing carrier according to claim 1, wherein a BET specific surface area A of the magnetic particles is in a range of 0.15 $m^2/g$ to 0.18 $m^2/g$.

4. The electrostatic charge image developing carrier according to claim 1, wherein at least a part of the magnetic particles is coated with a resin.

5. The electrostatic charge image developing carrier according to claim 4, wherein the resin contains a conductive material.

6. The electrostatic charge image developing carrier according to claim 5, wherein the conductive material contains at least one selected from the group consisting of carbon black, metal powder, titanium oxide, tin oxide, magnetite, and ferrite.

7. The electrostatic charge image developing carrier according to claim 6, wherein a DBP oil absorption amount of the carbon black is in a range of 50 mL/100 g to 250 mL/100 g.

8. An electrostatic charge image developer comprising:

a toner; and the electrostatic charge image developing carrier according to claim 1.

9. The electrostatic charge image developer according to claim 8, wherein a content of a binder resin of the toner is in a range of 40% by weight to 95% by weight with respect to the entirety of toner particles.

10. The electrostatic charge image developer according to claim 8, wherein a content of a colorant of the toner is in a range of 1% by weight to 30% by weight with respect to the entirety of toner particles.

11. The electrostatic charge image developer according to claim 8, wherein the content of a release agent of the toner is in a range of 1% by weight to 20% by weight with respect to the entirety of toner particles.

12. The electrostatic charge image developer according to claim 11, wherein a melting temperature of the release agent is in a range of 50° C. to 110° C.

13. The electrostatic charge image developer according to claim 8, wherein the toner has a core-shell structure.

14. The electrostatic charge image developer according to claim 8, wherein a volume average particle diameter (D50v) of the toner is in a range of 2 μm to 10 μm.

15. The electrostatic charge image developer according to claim 8, wherein a shape factor SF1 of the toner is in a range of 110 to 150.

16. A developer cartridge comprising the electrostatic charge image developer according to claim 8 and is detachable from an image forming apparatus.

* * * * *